United States Patent [19]

Zaner

[11] Patent Number: 4,586,585

[45] Date of Patent: May 6, 1986

[54] LONGITUDINALLY EXTENSIBLE STRINGER AND STAIRWAY

[76] Inventor: Leonard A. Zaner, 1300 Jerry St., Madison Heights, Mich. 48071

[21] Appl. No.: 765,644

[22] Filed: Aug. 15, 1985

[51] Int.-Cl.[4] ..... E06C 9/10; E06C 7/48

[52] U.S. Cl. ..... 182/97; 182/206; 182/207; 52/182

[58] Field of Search ..... 182/97, 206, 228, 207; 52/183, 182

[56] References Cited

U.S. PATENT DOCUMENTS

| | | | |
|---|---|---|---|
| 2,003,876 | 6/1935 | Birtcher | 52/182 |
| 2,720,354 | 10/1955 | Stanley | 228/25 |
| 2,854,292 | 9/1958 | Schaeffer | 182/206 |
| 2,867,855 | 1/1959 | Xanten | 182/97 |
| 2,899,008 | 8/1959 | Larson et al. | 182/25 |
| 3,059,723 | 10/1962 | Shore | 182/107 |
| 3,299,590 | 1/1967 | Carter | 182/97 |
| 3,470,664 | 10/1969 | Whitehead | 52/183 |
| 3,948,353 | 4/1976 | Lane | 182/206 |
| 4,106,591 | 8/1978 | Cohen et al. | 182/93 |
| 4,210,224 | 7/1980 | Kilmmerlin et al. | 182/207 |
| 4,367,689 | 12/1982 | Dever | 182/97 |

FOREIGN PATENT DOCUMENTS 3203164 1/1982 Fed. Rep. of Germany ..... 52/182

*Primary Examiner*—Reinaldo P. Machado

*Attorney, Agent, or Firm*—Gerald R. Hershberger

[57] ABSTRACT

My invention relates to an extensible stairway capable of being shipped in a knockdown condition and erected with a minimum of labor and without special tools. The stairway has a pair of stair step stringer assemblies each stringer assembly having a pair of telescoping channels nesting slidably together that can be extended to a required height. The vertical load bearing side walls of said channels are provided with a series of registering groups of equally step spaced in-line bores arranged to lie in a substantially horizontal line when the stringer channels are placed in stair inclined position. A plurality of stair step assemblies having tread supports are adapted to be swivably mounted and clamped to said groups of in-line bores to maintain the treads in a horizontal position when the stringers are inclined forwardly to an ascent angle. A rotatable bracket is located at the upper end of each of the inside channels enabling them to be mounted in an inclined position to the upper level of a structure. Clamping means is provided for fixedly securing said rotatable bracket individually to the upper level of the structure.

2 Claims, 8 Drawing Figures

LONGITUDINALLY EXTENSIBLE STRINGER AND STAIRWAY

My invention relates to stairs and more particularly to an extensible stairway assembly that can be distributed in kit form and readily assembled at the work site.

Readily assembled stairway kits and assemblies are known, however, the stairway assemblies of the prior art, although functioning well as a non-extensible, permanently structured stairway, do not meet the present demand for an extensible, sturdy, easily assembled stairway stringer for stairways which is inexpensive to manufacture, and is easily assembled at the installation site without special tools.

Therefore, it is a primary object of this, my invention, to provide a novel, open riser, extensible stairway stringer kit that is adaptable to be readily assembled at the installation site into a complete sturdy open riser stairway extendible to various heights at different work locations.

A further object of this invention is to provide a stairway stringer with stair step mounting members that are adjustable to maintain the steps in a horizontal plane when the stringer is positioned to different ascent angles.

It is a further object of the invention to provide a stairway stringer with a step level adjusting means and a stringer longitudinal extension adjusting means which means are adapted to interlock with each other at each step location to establish the correct step angle level and the correct stairway length to accommodate a specific stairway height and inclination.

It is a further object of the invention to provide a unique adjustable mounting apparatus attached to the upper end of the stringer for securing the upper end of the assembled stairway to the upper level of a structure.

It is a further object of this invention to provide a stairway kit having right and left hand adjustable stringer assemblies that are capable of being readily assembled at the installation site. After assembly, stair steps may be fixedly mounted between the stringer step supports and adjusted to the desired angle for walking, and the stringers and steps extended to the desired height and inclination for mounting the stairway to the predetermined upper level of a structure.

As a more specific object, my invention provides a sturdy, extensible stairway capable of being shipped in knocked down condition and erected with a minimum of labor and without special tools. The stairway comprises a pair of right and left stair step stringer assemblies, each stringer assembly having a pair of telescoping channels nesting slidably together, that can be extended to a required height. The vertical load bearing side walls of said channels are provided with a series of congruent registering groups of equally spaced in-line bores, arranged to be in a substantially horizontal plane when the stringer channels are placed in stair enclined position for climbing. A plurality of stair step assemblies having tread support members are adapted to be swivably mounted and clamped to said groups of in-line bores to maintain the treads in horizontal position with the stringers when the stringers are extended and inclined forwardly to the desired ascent angle, an adjustable bracket assembly is located at the upper end of each of the inside stringer channels enabling them to be mounted in an inclined position to the upper level of a structure. A clamping means is coordinated with said bracket assembly for fixedly securing said rotatable brackets individually to the upper level of the structure.

The above and other objects, features and advantages of the invention should become apparent from a study of the following description taken with the accompanying drawings wherein.

Figure 2:
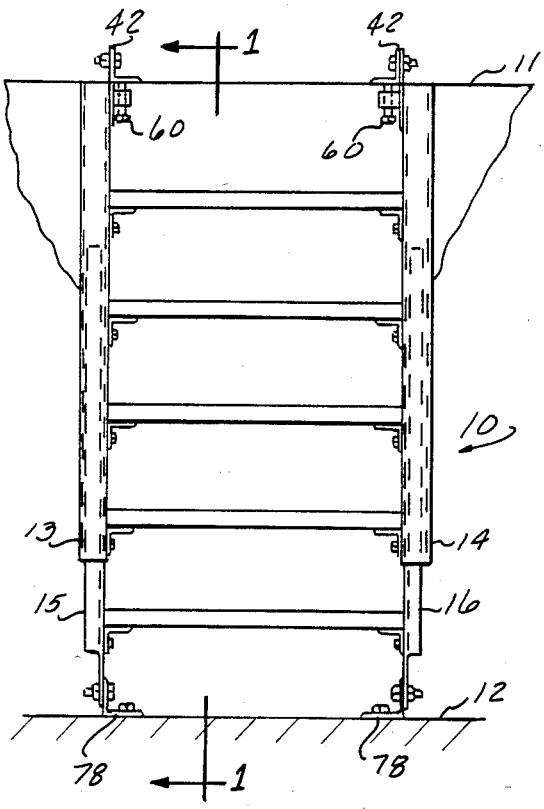
FIG. 2 is a front elevational view thereof.
Figure 1:
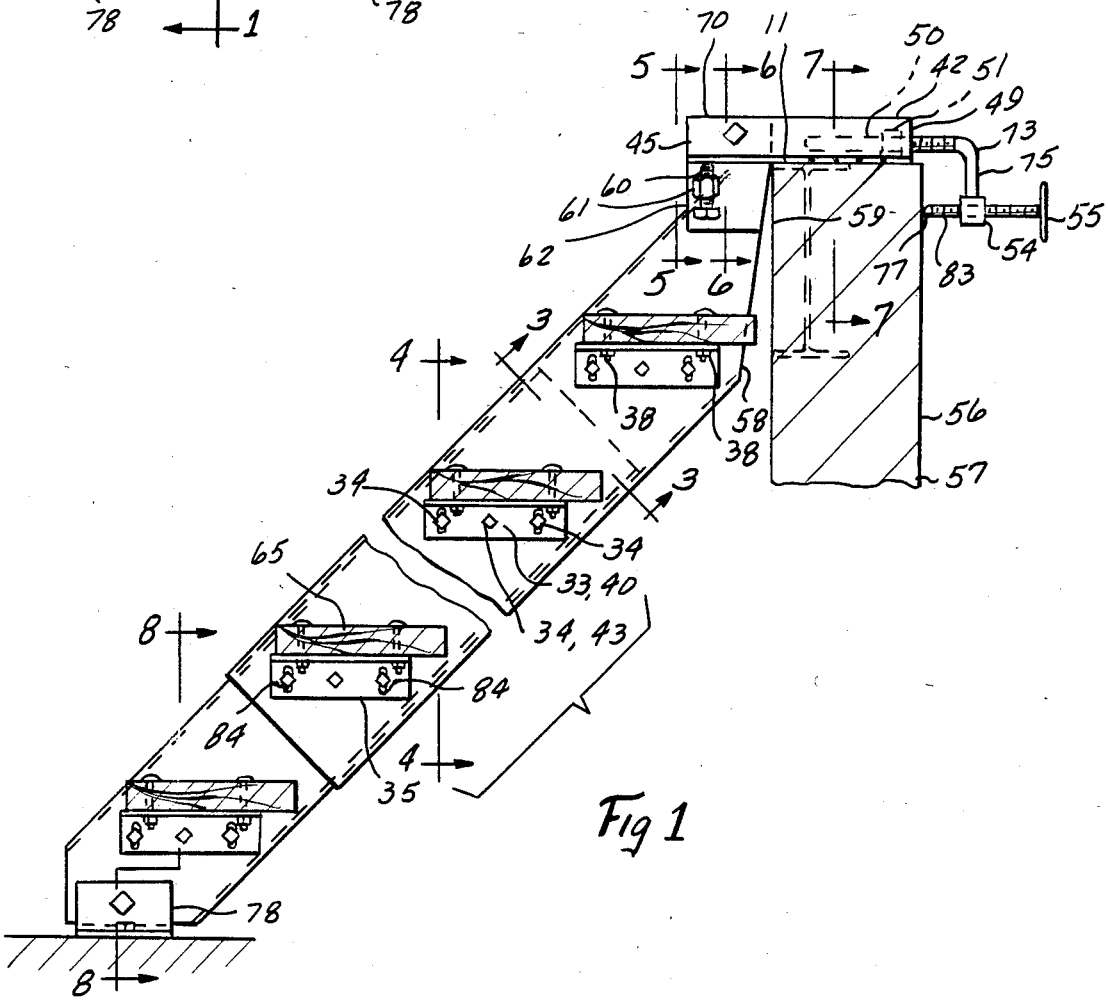
FIG. 1 is a side elevational view of an extensible open riser stairway embodying the present invention.
Figure 5:
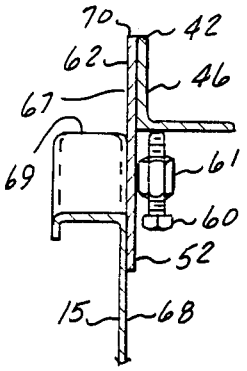
FIG. 5 is a sectional view taken along line 5—5 of FIG. 1
Figure 6:
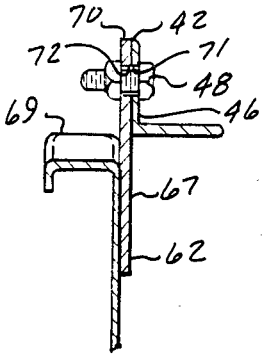
FIG. 6 is a sectional view taken along line 6—6 of FIG. 1
Figure 7:
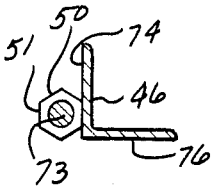
FIG. 7 is a sectional view taken along line 7—7 of FIG. 1
Figure 4:
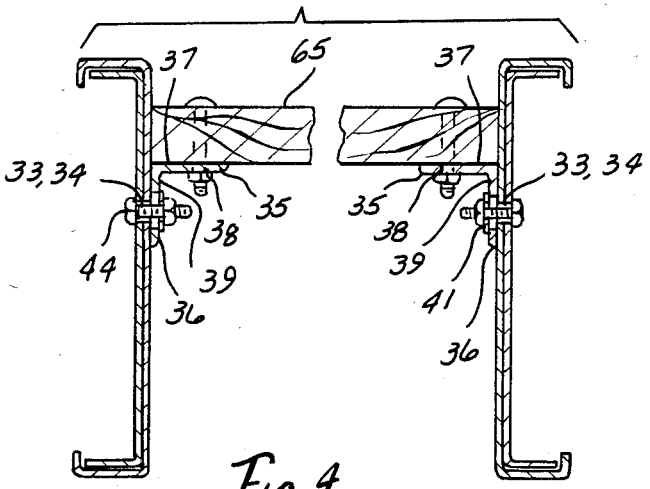
FIG. 4 is a sectional view taken along line 4—4 of FIG. 1

Referring now to the drawings, FIGS. 1 and 2 illustrate a stairway 10 which embodies the present invention. As shown in FIG. 1, the stairway 10 inclines between two levels of a structure such as the upper level 11 and the lower level 12. The stairway 10 may be provided with a handrail, not shown.

In accordance with the present invention, the stairway 10 is designed to be shipped from the factory in knocked down condition for assembly and installation by the ultimate consumer, whether he be a building contractor, homeowner, or do-it yourselfer. Neither special tools or special skills are required to assemble and disassemble the stairway 10, in a short period of time.

Figure 3:
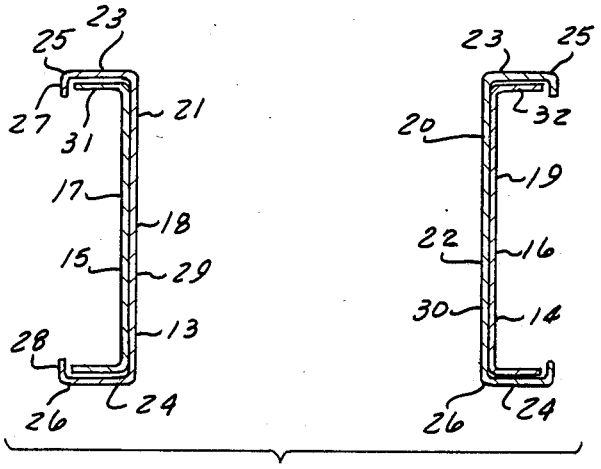
FIG. 3 is a sectional view taken on line 3—3 of FIG. 1
Figure 8:
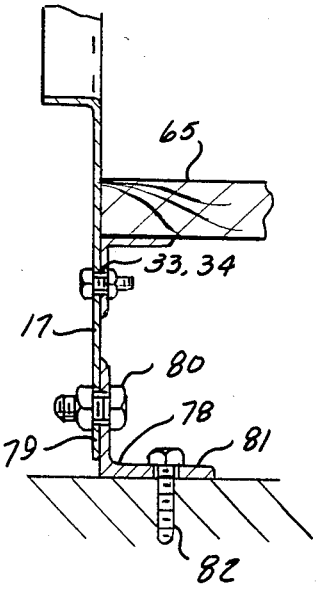
FIG. 8 is a sectional view taken along line 8—8 of FIG. 1

Basically the stairway 10 comprises a pair of juxtaposed extensible, elongated right and left hand stringer assemblies 13 and 14, each stringer assembly having a pair of elongated telescoping channel subassemblies 15 and 16 as shown in FIGS. 1 2 and 3.

Each channel subassembly having an outer channel member 17 nesting in an inner channel member 18 on the left hand stringer 13, and an outer channel member 19 nesting in an inner channel member 20 on the right hand stringer 14. The channel members 18 and 20 have relatively deep weight supporting vertical flat side wall portions 21 and 22 and top and bottom horizontal torsion resisting flanges 23 and 24, extending outwardly from said side walls 21 and 22. The ends 25 and 26 of the flanges 23 and 24 are bent downwardly to form inwardly bent short flanges 27 and 28 to retain the outer channel members 17 and 19 in laterally fixed telescoping relationship with the inner channel members 18 and 20.

The outer channel members 17 and 19 have side walls 29 and 30 and top and bottom flanges 31 and 32 which are coextensive slidably within the limits of the side walls, top flanges, and short flanges of the inner channels 18 and 20, which allows the outer channels to slide in a telescoping manner within the inner channels of the channel subassemblies to elongate or shorten such subassemblies.

The side walls inner and outer channels of said channel subassemblies have a plurality of registering linear groups 33 of three each congruent annular openings or cylindrical bores 34 located linearly on a step inclined angle between the top and bottom flanges of the inner and outer channel members. The groups of bores are spaced in uniform stair riser increments from each other along the channel so that a plurality of congruent groups of bores of an outer channel will register in congruent relationship with a plurality of groups of similar bores on the inner channel when the channel members are variably lengthened or shortened with respect to each other. The groups of bores are arranged so that an axis through a group of bores defines a horizontal line when the channel is tilted to a predetermined ascent incline.

The device further comprises a step riser means 35 arranged and adapted to cooperate with the groups of channel bores or connectors 34 to simultaneously locate and fix the inner and outer channels together at a predetermined length and for locating the steps horizontally when the channels are inclined to a desired angle for climbing.

The step riser means 35 includes a plurality of right angle iron like tread mounting brackets 36 having a horizontal top tread flange 37 with a pair of screw mounting bores 38 therethrough, and a vertical flange 39 having a group 40 of three annular openings spaced to register congruently with the groups 33 of the channel bores 34. The center bore 34 of the channel group and the center bore 43 of the riser angle group 40 have a bolt 44 and nut 41 attached therethrough which allows the bracket 36 to pivot thereabout. The outside bores of the angle group 40 register with outside two channel bores 34. The outside bores of the angle group are vertically slotted 84 to limit the rotation of the angle bracket, and bolts 44 and nuts 41 are fastened through the channel outside bores and tread angle support slotted bores 84 to clamp the channels and tread supports fixedly together.

As is now apparent, the tread support angles may be adjusted to a horizontal level when the channels are in an inclined position.

Referring to FIGS. 1, 5, 6 & 7, the invention further includes an upper end stringer mounting means, including a generally rectangularly outlined ladder extension plate 62, having an outside surface 67 fixedly mounted, such as by welding to the inside surface 68 of the upper end 69 of each right and left hand stringer subassemblies 15 and 16, a cantilevered pivotable upper level abutment engaging upper level right angle outlined bracket member 42 having one end 45 thereof pivotably mounted by vertical flange 46 to the upper end 70 of said extension plate by a bolt and nut 48 through bores 71 and 72 in said angle bracket and said ladder extension plate respectively. The other end 49 of said angle bracket is extended forwardly a substantial distance horizontally along an upper structure level 11 and fastened securely to said upper structure by an "L" shaped clamping bolt 73 extending forwardly beyond the end 49 of said angle bracket and having an extensive rearward threaded portion 50 adjustably engaging a threaded nut 51 which is welded to the outside wall 74 of said angle bracket adjacent the end 49 thereof. The forward end 75 of said clamping bolt 73 is bent downwardly a substantial distance below level 11, and is provided with a threaded opening 54 disposed axially parallel with rearward threaded portion 50 and the bottom wall 76 of said angle bracket. An elongated turn screw 55 having a threaded body 83 is threaded through said threaded opening 54 so that the end 77 engages the rear wall 56 of the abutment 57. When the screw 55 is tightened it tensions the upper end of each inner channel, which have a relieved edge 58 cut back to clear the vertical forward wall 59 of the abutment to allow the angle bracket to extend over the abutment level 11, fixedly against said forward wall. Adjustment of the angle of the upper level mounting bracket 42 is obtained by an adjusting screw 60 which is threaded through a nut 61 welded to the inside wall 52 of plate 62 at right angles to the bottom wall 76 of said angle bracket. Tightening and relieving the screw 60 causes the bracket 42 to pivot about bolt 48 thereby varying the angle of the bracket 42 within the limits of the predetermined different angles of ascent.

The treads 65 may be included with the kit as delivered to the installation site, or they may be furnished by the user. They are mounted as disclosed in FIGS. 1, 2.3 and 8, by bolts and nuts 66 through the tread support flange bores 38.

As indicated in FIG. 1, the tread supports or brackets 36 may be fastened both inner and outer channels when the groups of bores register with each other, or may be fastened to the inner channel only when the stairway is extended.

In each case the treads may be adjusted to a horizontal position when the stairway is inclined. The preferred angle of ascent is from 38 degrees to 51 degrees with the horizontal, and the preferred stairway extension limits are from 8 feet to 13 feet taken vertically from a lower level to an upper level.

A front ladder support means 78 is pivotably mounted to the lower end 79 of each outer channel 17 and 19 by nuts and bolts 80 in conventional manner. The foot 81 may be secured to the floor by bolts 82.

While I have disclosed one embodiment of the invention it is to be understood that these embodiments are given by example only and not in a limiting sense.

I claim:

1. A stringer means for a stairway comprising;

an elongated stair step stringer assembly having two generally |—| outlined elongated telescoping channels nesting slidably together including an outer channel member nesting in an inner channel member, both channel members having comparatively deep weight supporting flat side wall portions, and substantially shorter torsion resisting flanges, including a top flange and a bottom flange of generally equal length and of comparatively less width than the side wall depth and bent outwardly normal to the side walls;

each of said stringer side walls having registering groups of cylindrical bores therethrough aligned angularly and transversely between the top and bottom channel flanges and spaced longitudinally in uniform stair riser increments from each other, so that a plurality of groups of bores will register with another plurality of group of bores when the channel members are variably extended or shortened with respect to each other, and the line of the bores will assume a substantially horizontal position when the stringer is placed in an inclined position for climbing;

and step riser means associated with said stringer means including a plurality of angle iron like tread mounting brackets having a top tread flange and pre-formed bores in the other flange thereof for attaching the brackets pivotably to the inside wall face of the inside channel with the bracket bores registering with a group of channel bores, with one of the bracket bores acting as a pivot and another bracket bore being slotted to permit the bracket to be adjusted radially with respect to the stringer channels to maintain the horizontal position of the top tread flange with respect to the incline of of the stringer.

2. The invention as set forth in claim one including an upper end stringer mounting means having a pivotable abutment engaging upper angle iron like bracket having one end pivotably mounted by a flange to the upper end of said inside channel and the other end cantilevered a sustantial distance outwardly of said inside channel with the flange side down;

and means mounted on said upper cantilevered bracket operable to engage said upper flange of said inner channel to secure said cantilevered bracket in a horizontal position.

* * * * *